US006223981B1

(12) United States Patent
Gunder

(10) Patent No.: US 6,223,981 B1
(45) **Date of Patent: *May 1, 2001**

(54) BOX FOR BAG-IN-BOX PACKAGE

(75) Inventor: Terri Lei Gunder, Lawrenceville, GA (US)

(73) Assignee: The Coca-Cola Company, Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/996,830

(22) Filed: Dec. 23, 1997

(51) Int. Cl.[7] ..... B65D 5/54; B65D 5/56

(52) U.S. Cl. ..... 229/242; 229/117.3; 229/117.35

(58) Field of Search ..... 229/117.3, 117.35, 229/122.24, 242; 220/FOR 115, FOR 122, FOR 173, FOR 174, FOR 177; 222/105, 183, 541.6

(56) References Cited

U.S. PATENT DOCUMENTS

| | | | | |
|---|---|---|---|---|
| 2,954,901 | * | 10/1960 | Winstead | 222/541.6 |
| 3,090,526 | * | 5/1963 | Hamilton et al. | 229/117.35 |
| 3,173,579 | * | 3/1965 | Curie et al. | 229/242 |
| 3,318,505 | * | 5/1967 | Garrison et al. | 222/105 |
| 3,756,471 | * | 9/1973 | Wissman | 229/117.3 |
| 3,908,864 | * | 9/1975 | Capper | 222/105 |
| 4,623,075 | * | 11/1986 | Riley | 222/105 |
| 5,048,691 | | 9/1991 | Heuberger et al. . | |
| 5,054,644 | | 10/1991 | Greenslade . | |
| 5,069,385 | | 12/1991 | Färber | 229/137 |
| 5,083,678 | | 1/1992 | Waring | 222/92 |
| 5,143,278 | | 9/1992 | Petriekis et al. . | |
| 5,176,313 | | 1/1993 | Curry et al. | 229/125 |
| 5,195,661 | | 3/1993 | Light | 222/105 |
| 5,197,625 | | 3/1993 | Mullaney . | |
| 5,494,216 | | 2/1996 | Van Suntenmaartensdijk | 229/215 |
| 5,566,878 | | 10/1996 | Peiffer et al. | 229/117 |

FOREIGN PATENT DOCUMENTS

| | | | | |
|---|---|---|---|---|
| 713420 | * | 7/1965 | (CA) | 222/183 |

* cited by examiner

*Primary Examiner*—Gary E. Elkins
(74) *Attorney, Agent, or Firm*—Sutherland Asbill & Brennan, LLP

(57) ABSTRACT

A box for enclosing a flexible, collapsible bag having a closed spout. The box has a first panel, a second panel intersecting the first panel, and a plurality of other panels intersecting with the first panel and the second panel to form an enclosure. A spout access flap is formed at the intersection of the first panel and the second panel and extends substantially radially along these panels. The spout access flap is positioned directly over the closed spout of the flexible, collapsible bag such that the closed spout is accessible when the spout access flap is opened.

14 Claims, 4 Drawing Sheets

BOX FOR BAG-IN-BOX PACKAGE

TECHNICAL FIELD

This invention relates generally to a corrugated board box, and more particularly relates to a corrugated board box for use with a flexible, collapsible bag and also to means for providing access to the spout of the bag.

BACKGROUND OF THE INVENTION

Corrugated board boxes have long been used for packing and shipping almost any type of product or material. These corrugated board boxes are relatively inexpensive, lightweight, and have sufficient strength and rigidness. One example of the use of a corrugated board box is the delivery of fluids contained in an impermeable plastic pouch. These fluids include beverages such as soft drink syrup, milk, and water. This arrangement of the fluid pouch in the corrugated board box is known in the soft drink industry as a "bag-in-box."

FIG. 1 shows a prior art blank for a corrugated board box 10 for use with a soft drink syrup "bag-in-box." The soft drink syrup is placed in the impermeable plastic bag 20. The bag 20 is generally a pillow shaped bag with a spout 30 on one end as shown in FIG. 2. The box 10 is constructed by bending the corrugated board 40 along the score lines 50 (the dashed lines) and gluing the respective flaps 60 in place until an open-ended box is formed. The bag 20 is placed within the box 10 and the open flaps 60 are glued together such that the box 10 is sealed. The box 10 is then shipped to the customer.

To access the syrup bag 20, the customer opens a spout flap 70 on the box 10 and reaches in to find the spout 30. The spout flap 70 is defined by a series of perforations 80 in one or more layers of the corrugated board 40. The customer grasps the spout 30 and attaches a line from the customer's dispensing machine (not shown) or otherwise empties the syrup bag 20. The corrugated board box 10 thus provides for ease of shipment and also provides a support container for the syrup bag 20 while the syrup bag 20 is attached to the dispensing machine.

The drawbacks with this known box design are several. First, many customers find the known perforated spout flap 70 difficult to open. Because the spout flap 70 is on the top of the box 10, there is little structure or rigidness at that location for the customer to push down and open the perforations 80. Further, some customers find it difficult to push through the two (2) layers of the corrugated board 40 on the top of the box 10. Customers therefore have used various types of blunt objects to force the perforations 80 open. The use of such blunt objects, however, sometimes results in the perforation of the syrup bag 20.

Second, customers often find it difficult to locate the spout 30 after the spout flap 70 is opened and removed. Due to the nature and design of the typical syrup bag 20, the spout 30 tends to be located near the top corner of the box 10 rather than under the spout flap 70 on the top of the box 10. The customer therefore would search into the box 10 in attempting to find the spout 30. This searching also occasionally resulted in the perforation of the syrup bag 20.

What is needed therefore is a corrugated board box for use with a fluid pouch that is both easy for the customer to open and easy for the customer to use. The box must provide sufficient rigidness to ensure the safe delivery and use of the enclosed pouch while being easy to open without undue force or perforation of the pouch. Further, the box must provide easy access to the pouch and the spout.

SUMMARY OF THE INVENTION

The present invention provides a box for enclosing a flexible, collapsible bag having a closed spout. The box has a first panel, a second panel intersecting the first panel, and a plurality of other panels intersecting with the first panel and the second panel to form an enclosure. A spout access flap is formed at the intersection of the first panel and the second panel and extends substantially radially along these panels. The spout access flap is positioned directly over the closed spout of the flexible, collapsible bag such the closed spout is accessible when the spout access flap is opened.

Specific embodiments of the present invention include making the box out of corrugated board. The spout access flap is defined by a series of perforations in the corrugated board. The spout access flap is substantially larger than the closed spout of the flexible, collapsible bag. The spout access flap further includes a thumb opening positioned on the second panel. The first panel of the spout access flap is a top lid having an outer flap overlapping an inner flap. The second panel of the box and the outer flap of the spout access flap are formed from a single sheet of the corrugated material. The bag has a first and a second side and a first and a second end. The spout is positioned on the first side of the bag adjacent to the first end. The spout access flap is positioned over the first side and the first end of the fluid bag.

The method of the present invention provides for the transport and use of a bag with a spout in a bag-in-box package. The method includes the steps of enclosing the bag within the corrugated box. The corrugated box has a first panel intersecting with a second panel at a corner and further includes a spout access flap extending along the first panel and the second panel from the corner. The spout access flap has a thumb opening on the second panel. The method further includes the steps of transporting the bag within the corrugated box, grasping the corrugated box along the corner, inserting a finger within the thumb opening, lifting the spout access flap along the second panel, lifting the spout access flap along the first panel to form a spout opening, reaching within the spout opening, and grasping the spout. The method may further include the steps of removing the spout access flap, filling the bag with a soft drink syrup, and hooking the spout up to a line of a soft drink dispensing machine.

It is thus an object of the present invention to provide an improved bag-in-box.

It is another object of the present invention to provide a corrugated board box that is easy to open.

It is a further object of the present invention to provide a corrugated board box for the transport and use of a bag for a bag-in-box.

It is a still further object of the present invention to provide a corrugated board box that provides easy access to the spout of a bag.

Other objects, features and advantages of the present invention will become apparent upon reviewing the following description of preferred embodiments of the present invention, when taken in conjunction with the drawings and the appended claims.

DETAILED DESCRIPTION OF THE INVENTION

Figure 1:
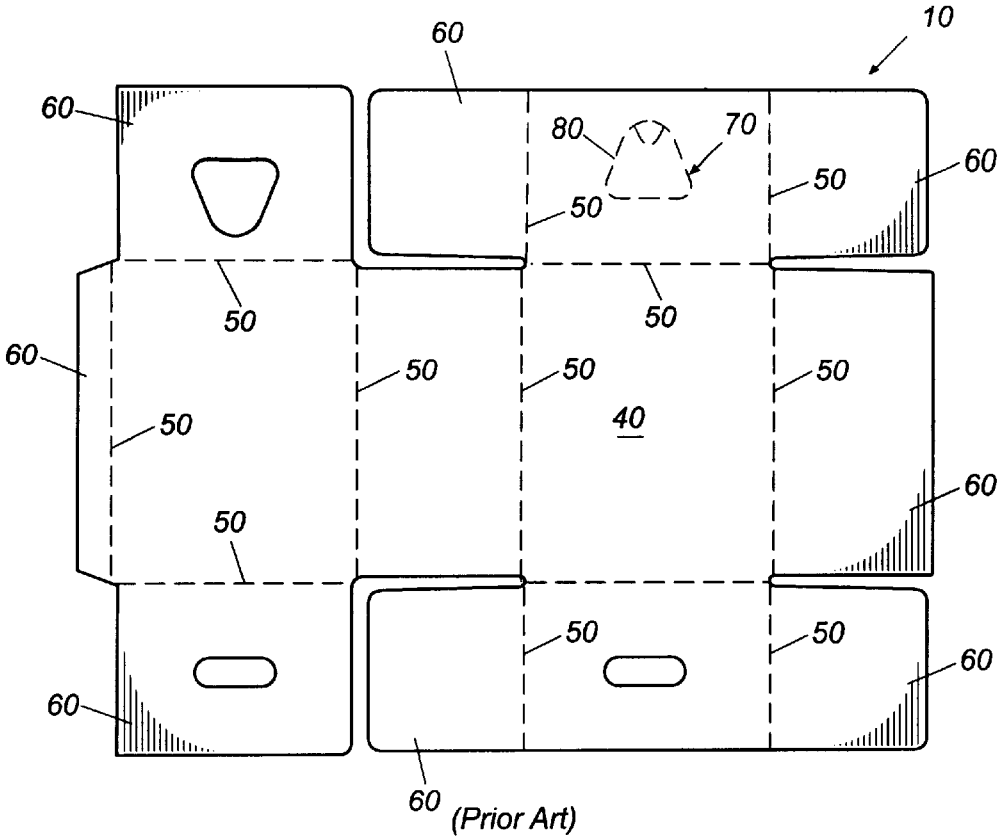
FIG. 1 shows a plan view of a blank used for making a prior art box.
Figure 2:
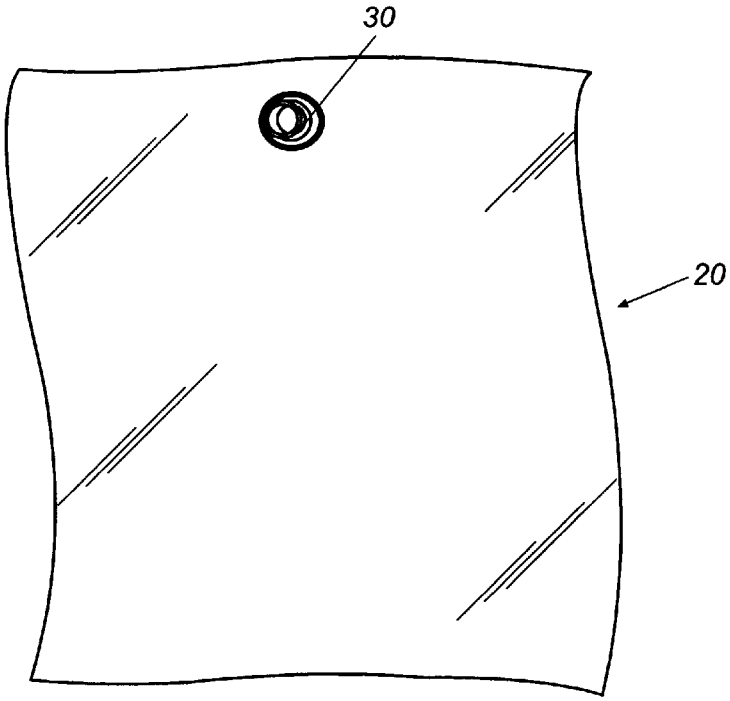
FIG. 2 is a plan view of a bag for use with the box of the present invention.
Figure 3:
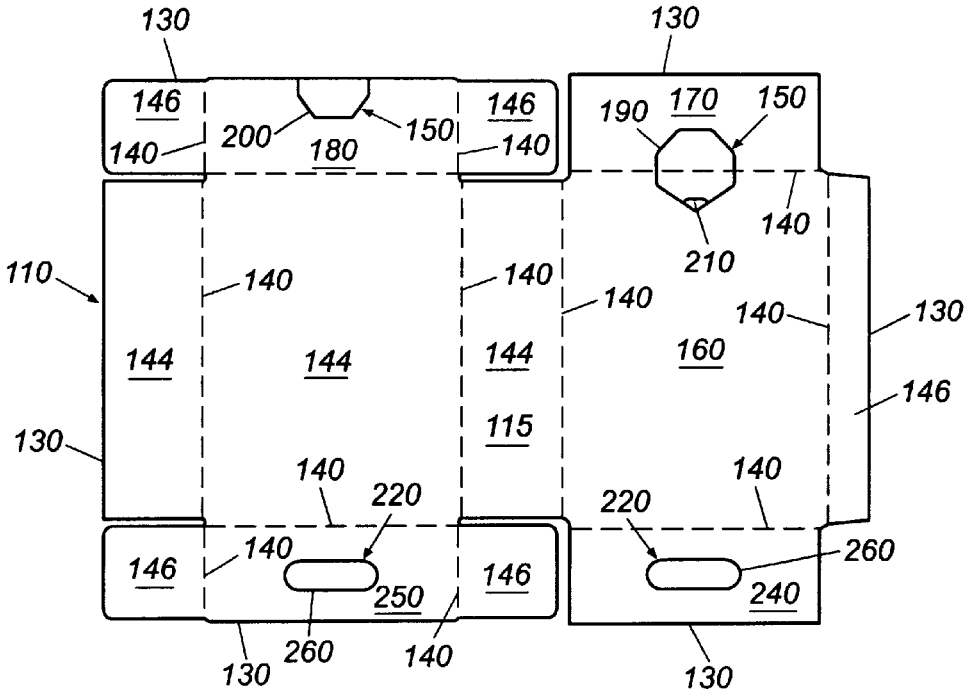
FIG. 3 is a plan view of the blank used for making the box of the present invention.
Figure 4:
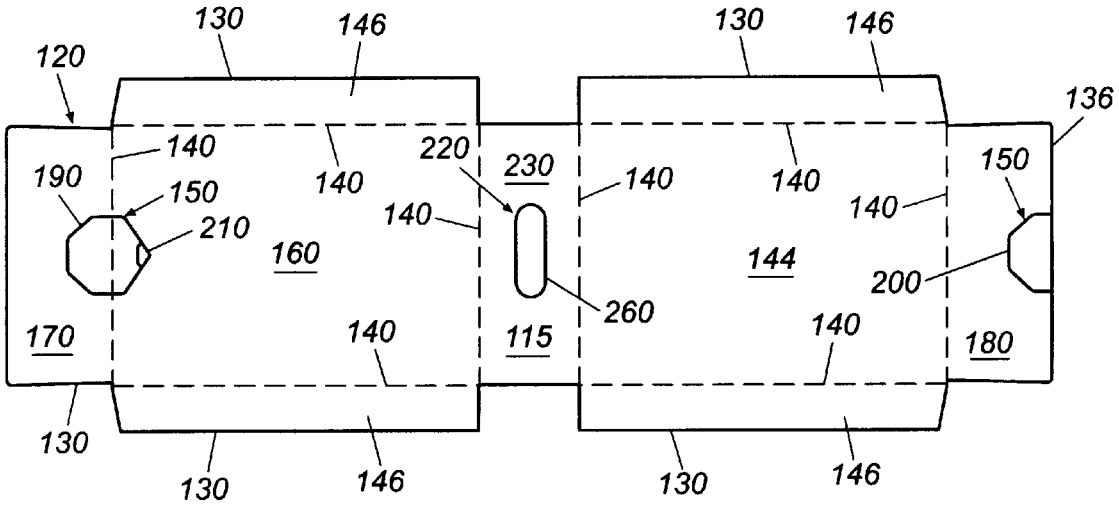
FIG. 4 is a plan view of the blank used for making a second embodiment box of the present invention.
Figure 5:
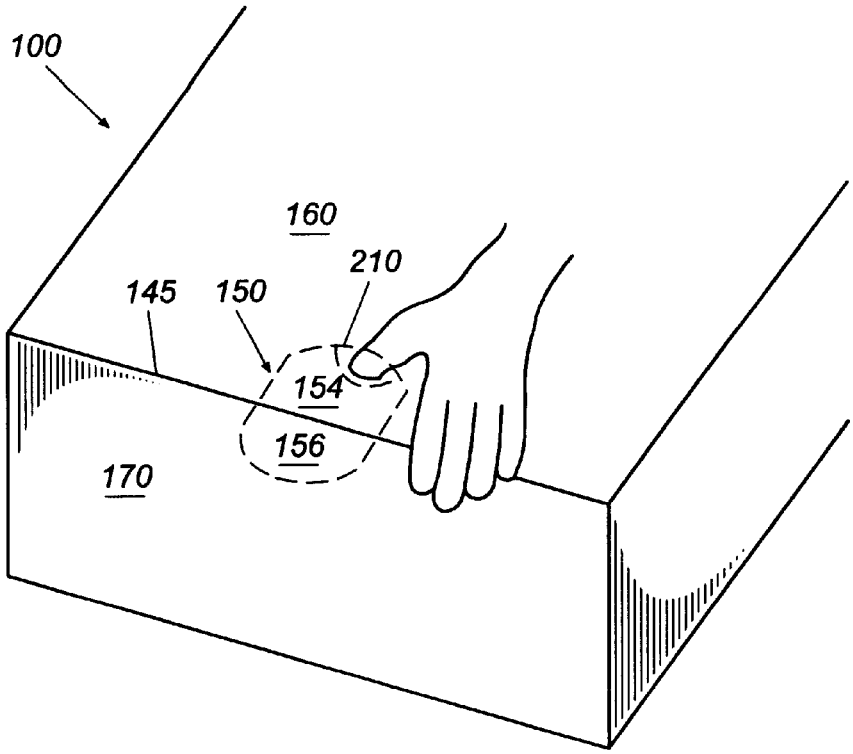
FIG. 5 is a perspective view showing the opening of the spout access flap.

Referring now in more detail to the drawings in which like numerals refer to like parts throughout the several views, FIGS. 3–7 show a box 100 embodying the present invention. The box 100 is cut from one or more pieces of corrugated board 115. FIG. 3 shows a blank 110 for a one (1) piece box 100. FIG. 4 shows a blank 120 for a three (3) piece box 100. The blanks 110, 120 are the unfolded pieces of the corrugated board 115 used to make the boxes 100. The differences in construction between the one (1) piece box and the three (3) piece box are immaterial for the purposes of this disclosure. The different boxes 100 are used with different types of manufacturing equipment.

The blanks 110, 120 shown in FIGS. 3 and 4 both have cut lines (solid lines) 130 and score lines (dashed lines) 140. The cut lines 130 indicate how the blanks 110, 120 are to be cut from the corrugated board 115 and where sections of the blanks 110, 120 are to be perforated or otherwise specially cut as described below. The score lines 140 indicate where the blanks 110, 120 are to be bent. The cut lines 130 and the score lines 140 form a plurality of panels 144 and flaps 146. These panels 144 and flaps 146 form the completely enclosed box 100 when folded and glued together.

In both the blanks 110, 120, a perforated spout access flap 150 extends along several of the panels 144 and the flaps 146. Specifically, the spout access flap 150 extends along a top panel 160, a major outer flap 170, and a major inner flap 180. The top panel 160 and the major outer flap 170 are separated by a score line 140. When the blanks 110, 120 are folded according to the score lines 140 to form a corner 145, the major outer flap 170 overlays the major inner flap 180. The flaps 170, 180 are then glued together. Because both the blanks 110, 120 use the same spout access flap 150 design, only the piece of corrugated board 115 showing the spout access flap 150 on the blank 120 is shown in FIG. 4.

The spout access flap 150 is defined by a series of perforations 190 along the top panel 160, the major outer flap 170, and the major inner flap 180. The perforated spout access flap 150 forms a seven (7) or eight (8) sided enclosed shape that is roughly divided equally on the top panel 160 and the overlapping major outer flap 170 and the major inner flap 180 along the corner 145. The perforated spout access flap 150 extends substantially radially from the corner 145. The perforations 190 are preferably about ⅛ inch by about ⅛ inch in length and extend substantially through the thickness of the corrugated board 115. In other words, the corrugated board 115 is cut through the width of the corrugated board 115 for a distance of about ⅛ inch followed by a no cut range for a distance of about ⅛ inch. The major inner flap 180 of the spout access flap 150 also may be defined by the perforations 190 or, alternatively, a similar type of cut. One example of an alternative type of cut is a "M-Press" line 200. It is understood that "M-Press" is an industry term used by Container Graphics Corporation of Stone Mountain, Ga., to describe a cut in which the first several layers of the corrugated board 115 are completely cut while the bottom layers of the corrugated board 115 remain uncut.

The spout access flap 150 also may define a thumb opening 210 positioned at one end of the perforated spout access flap 150 on the top panel 160. The thumb opening 210 is "slit-scored", or has a larger perforation 190 for easy opening by the customer. For example, about a ¼ inch by about a ⅛ inch perforation 190 in the corrugated board 115 is used, with the ¼ inch distance indicating the cut length.

Each blank 110, 120 also may have a handle opening 220 positioned on a back panel 230 of the blank 120 of FIG. 4 or in both a outer side panel 240 and a inner side panel 250 of the blank 110 of FIG. 3. The handle opening 220 also is defined by a series of the perforations 260 in the corrugated board 115. These perforations 260 are preferably about ⅛ inch by about ⅛ inch as described above.

In use, the blanks 110, 120 are cut from the corrugated board 115 along the cut lines 130. The blanks 110, 120 are folded along the score lines 140 and the respective panels 144 and flaps 146 are generally glued together other than the major flaps 170, 180 or the panels 230, 240, 250. The flexible, collapsible bag 20 is then inserted into the box 100 with the spout 30 facing the perforated spout access flap 150. The bag 20 is a conventional flexible, substantially impervious plastic material approved for use with consumable products. Any conventional type of bag-in-box bag 20 may be used. The bag 20 may be glued or otherwise affixed within the box 100. After the bag 20 is inserted in the box 100, the open flaps 170, 180 or panels 230, 240, 250 are glued shut. The box 100 is then delivered to the customer.

Figure 6:
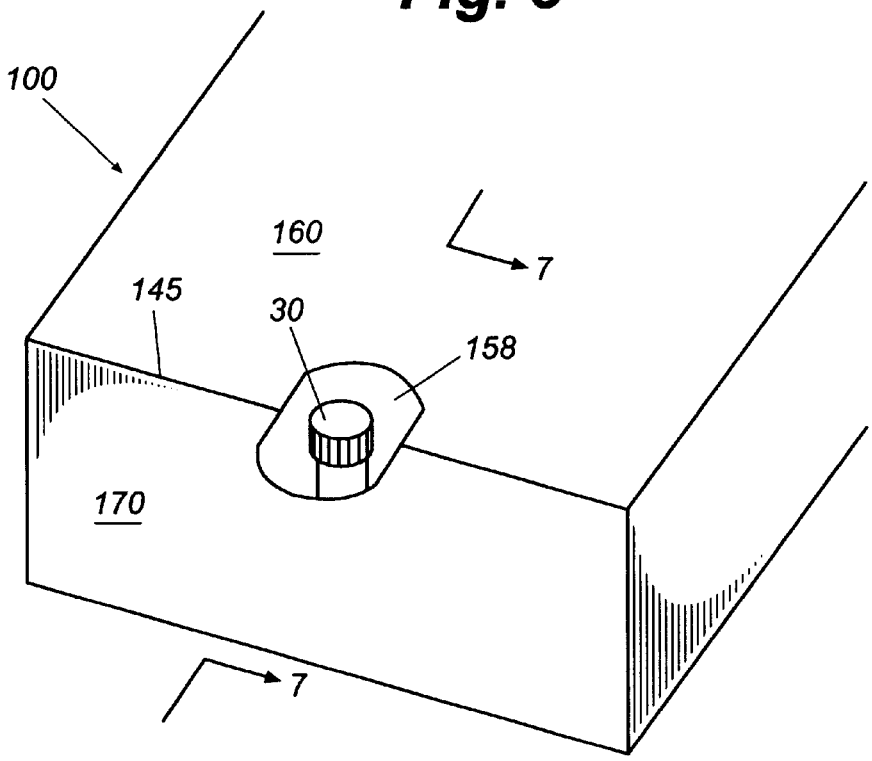
FIG. 6 is a perspective view showing the spout in the spout opening.

As is shown in FIG. 6, once the customer obtains the box 100, the customer can open the perforated spout access flap 150 by grabbing the top panel 160 and the major outer flap 170 along the corner 145 and placing his or her thumb or other finger in the thumb opening 210. Due to the nature of the large perforations 215 around the thumb opening 210, the thumb opening 210 is easily penetrated. Once the customer's thumb is inserted in the thumb opening, the customer can easily lift a portion 154 of the perforated spout access flap 150 on the top panel 160. This portion 154 of the perforated spout access flap 150 is easily opened due to the fact that there is only one (1) layer of corrugated board 115 to be removed. Once the portion 154 of the perforated spout access flap 150 on the top panel 160 is open, the customer can grasp that portion 154 of corrugated board 115 and open a remaining portion 156 of the perforated spout access flap 150 on the outer flaps 170, 180. The perforated spout access flap 150 can either remain attached to the box 100 by the last several perforations 190 or removed entirely. After the perforated spout access flap 150 is opened, a spout opening 158 is formed on the box 100.

Figure 7:
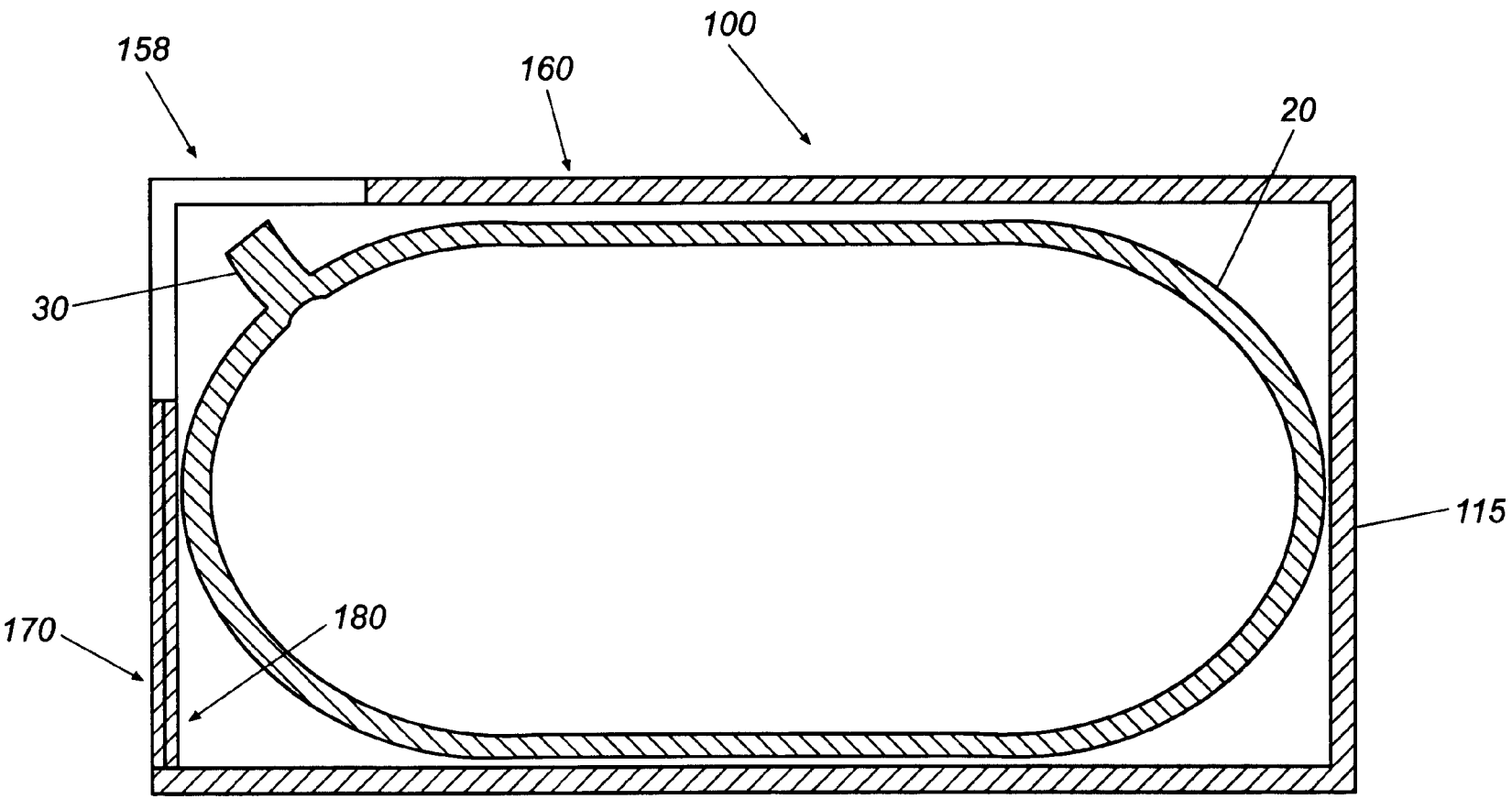
FIG. 7 is a cross-sectional view of the bag-in-box of the present invention taken along line 7—7 of FIG. 6.

As is shown in FIG. 7, due to the positioning of the perforated spout access flap 150 with respect to the spout 30 of the bag 20, the spout 30 is directly accessible once the perforated spout access flap 150 is opened or removed. The customer grabs the spout 30 through the spout opening 158 and attaches a line from a dispensing machine (not shown) or otherwise empties the bag 20. The customer no longer needs to reach within the box 100 to find the spout 30.

It should be understood that the foregoing relates only to the preferred embodiments of the present invention and that numerous changes may be made herein without departing from the spirit and scope of the invention as defined by the following claims.

I claim:

1. A box for enclosing a flexible, collapsible bag including a closed spout, said box comprising:

a first panel;

said first panel comprising a first flap;

a connecting panel intersecting said first panel;

a second panel intersecting with said connecting panel;

said second panel comprising a second flap;

said first flap, said second flap, and said second panel each comprising a perforation;

said perforations forming a spout access flap such that said closed spout is accessible when said spout access flap is opened.

2. The box for enclosing a flexible, collapsible bag of claim 1, wherein said first flap comprises a first crease and a first flap leading edge.

3. The box for enclosing a flexible, collapsible bag of claim 2, wherein said second flap comprises a second crease and a second flap leading edge.

4. The box for enclosing a flexible, collapsible bag of claim 3, wherein said first panel comprises a parallel position with respect to said second panel.

5. The box for enclosing a flexible, collapsible bag of claim 4, wherein said first flap overlaps said second flap such that said first flap leading edge aligns with said second crease.

6. The box for enclosing a flexible, collapsible bag of claim 5, wherein said perforations of said spout access flap extend radially from said first flap leading edge along first flap.

7. The box for enclosing a flexible, collapsible bag of claim 6, wherein said perforations of said spout access flap extend radially from said second crease along both said second panel and said second flap.

8. The box for enclosing a flexible, collapsible bag of claim 7, wherein said spout access flap comprises said plurality of perforations along said first flap, said second flap, and said second panel such that said spout access flap may be removed by tearing said second panel along said plurality of perforations and by tearing said first lid and said second lid along said plurality of perforations.

9. The box for enclosing a flexible, collapsible bag of claim 1, wherein said spout access flap is substantially larger than said closed spout of said flexible, collapsible bag.

10. The box for enclosing a flexible, collapsible bag of claim 1, further comprising corrugated board.

11. The box for enclosing a flexible, collapsible bag of claim 1, wherein said spout access flap further comprises a thumb opening positioned on said second panel.

12. A box for enclosing a bag with a closed spout, said box comprising:

a first panel;

said first panel comprising a first flap;

said first flap comprising a first crease and a first flap leading edge;

a connecting panel intersecting said first panel;

a second panel intersecting with said connecting panel such that said first panel and said second panel comprise parallel positions;

said second panel comprising a second flap;

said second flap comprising a second crease and a second flap leading edge;

said first flap and said second flap positioned such that said first flap overlaps said second flap such that said first flap leading edge aligns with said second crease;

said first flap, said second flap, and said second panel comprising a plurality of perforations;

said perforations extending radially from said first flap leading edge along said first flap and from said second crease along said second panel and said second flap; and said plurality of perforations comprising a spout access flap;

said spout access flap being removed by tearing said second panel along said plurality of perforations and by tearing said first flap and said second flap along said plurality of perforations.

13. The box for enclosing a flexible, collapsible bag of claim 12, further comprising corrugated board.

14. The box for enclosing a flexible, collapsible bag of claim 12, wherein said spout access flap further comprises a thumb opening positioned on said second panel.

* * * * *